US009460623B2

(12) United States Patent
Baughman et al.

(10) Patent No.: US 9,460,623 B2
(45) Date of Patent: Oct. 4, 2016

(54) PARKING MANAGEMENT

(75) Inventors: Aaron K. Baughman, Silver Spring, MD (US); Barry M. Graham, Silver Spring, MD (US); Rick A. Hamilton, II, Charlottesville, VA (US); Brian M. O'Connell, RTP, NC (US)

(73) Assignee: INTERNATIONAL BUSINESS MACHINES CORPORATION, Armonk, NY (US)

( * ) Notice: Subject to any disclaimer, the term of this patent is extended or adjusted under 35 U.S.C. 154(b) by 1070 days.

(21) Appl. No.: 12/951,548

(22) Filed: Nov. 22, 2010

(65) Prior Publication Data

US 2012/0130872 A1 May 24, 2012

(51) Int. Cl.

| | |
|---|---|
| ***G08G 1/14*** | (2006.01) |
| ***G07B 15/02*** | (2011.01) |
| ***G07F 17/24*** | (2006.01) |

(52) U.S. Cl.

CPC ..... *G08G 1/146* (2013.01); *G07B 15/02* (2013.01); *G07F 17/246* (2013.01)

(58) Field of Classification Search

None

See application file for complete search history.

(56) References Cited

U.S. PATENT DOCUMENTS

| | | | | |
|---|---|---|---|---|
| 5,351,187 | A | 9/1994 | Hassett | |
| 6,340,935 | B1 | 1/2002 | Hall | |
| RE37,822 | E | 8/2002 | Anthonyson | |
| 6,559,776 | B2 | 5/2003 | Katz | |
| 7,215,255 | B2 | 5/2007 | Grush | |
| 7,330,131 | B2 | 2/2008 | Zanotti et al. | |
| 7,492,283 | B1 | 2/2009 | Racunas, Jr. | |
| 7,533,809 | B1 | 5/2009 | Robinson et al. | |
| 7,899,473 | B2 | 3/2011 | Pohutsky et al. | |
| 7,956,769 | B1 | 6/2011 | Pearl | |
| 2005/0096974 | A1 | 5/2005 | Chagoly et al. | |
| 2005/0168352 | A1 | 8/2005 | Tomer | |
| 2007/0197231 | A1 | 8/2007 | Lin | |
| 2007/0267479 | A1 * | 11/2007 | Nix et al. | 235/379 |
| 2010/0117863 | A1 * | 5/2010 | Dutt | 340/932.2 |
| 2011/0035261 | A1 * | 2/2011 | Handler | 705/13 |
| 2011/0133957 | A1 | 6/2011 | Harbach et al. | |

OTHER PUBLICATIONS

B. Zoghi et al., "RFID Solutions: Parking Optimization and Customer Satisfaction", IJME—Intertech Conference, Texas A&M University, 2006, 10 pages.

S. Shaheen et al., "Smart Parking Management Field Test: A Bay Area Rapid Transit . . . ", Institute of Transportation Studies, University of California, Jan. 2005, 137 pages.

M. Inman, "Parking Management Study—Task Two Preliminary Report (DRAFT)", Carl Walker, Inc., Feb. 12, 2007, pp. 1-35.

"Downtown Chandler Parking Study (Draft Report)", Carl Walker, Inc., Oct. 22, 2008, 176 pages.

Office Action dated Feb. 14, 2013 for U.S. Appl. No. 13/588,334; 12 pages.

(Continued)

*Primary Examiner* — Ryan Zeender

*Assistant Examiner* — Denisse Ortiz Roman

(74) *Attorney, Agent, or Firm* — Lisa Ulrich; Andrew M. Calderon; Roberts Mlotkowski Safran Cole & Calderon, P.C.

(57) ABSTRACT

A parking management approach includes associating a payment source with a vehicle identifier. The approach also includes receiving a message indicating initiation of a parking event at a parking location, and updating a parking database to indicate that a vehicle having the vehicle identifier is parked at the parking location. The message includes an identification of at least one of the payment source and the vehicle identifier.

1 Claim, 5 Drawing Sheets

(56) References Cited

OTHER PUBLICATIONS

Office Action dated Sep. 23, 2015 in U.S. Appl. No. 13/588,334, 20 pages.

Office Action dated Jun. 3, 2015 for U.S. Appl. No. 13/588,334; 15 pages.

Final Office Action dated Jul. 10, 2013 for U.S. Appl. No. 13/588,334; 16 pages.

* cited by examiner

PARKING MANAGEMENT

TECHNICAL FIELD

The present invention generally relates to parking management and, more particularly, to methods and systems for enhanced parking management involving linking a payment source to a vehicle identifier.

BACKGROUND

A common method of paying for parking a vehicle in a parking garage, parking lot, or metered parking spot (also referred to as a parking space) involves dispensing a paper receipt to the vehicle owner at the beginning of the parking event. In some techniques, the paper receipt (also referred to as a ticket, slip, coupon, etc.) indicates a pre-paid for right to park for a predetermined amount of time, and the paper receipt is displayed on the vehicle during the term of the parking. For example, a patron (e.g., person wishing to park their vehicle) estimates how long they will park, pays for a predetermined amount of parking time, is provided with a paper receipt corresponding to the paid for time, and displays the paper receipt in a visible location in or on their vehicle (e.g., on the dashboard or adhered to a window). Parking enforcement in such situations involves looking for vehicles that do not have a receipt displayed, and also looking for vehicles that have an expired receipt displayed.

These paper receipts, however, may be lost by the patron. Also, the patron may inadvertently fail to display the paper receipt in a visible location on their vehicle during the parking. Additionally, parking enforcement personnel may fail to see and/or recognize a valid and properly displayed paper receipt. Furthermore, the receipt is not weatherproof, meaning that it can fade, become damaged to due moisture, or blow away if used in an open vehicle such as a motorcycle or convertible automobile. All of these issues have the potential to cause a negative impact, such as a citation or towing, on a patron who has properly paid for parking.

Moreover, the aforementioned receipt systems require a patron to purchase a predetermined amount of parking time. The receipt typically indicates the start time, end time, and duration of the paid for parking. In situations when the patron leaves the parking spot prior to the end of the paid for parking term, the patron loses the cost of the time period that was paid for but ultimately not used.

SUMMARY

In a first aspect of the invention, there is a parking management method implemented in a computer infrastructure having computer executable code tangibly embodied on a computer readable storage medium having programming instructions operable to: associate a payment source with a vehicle identifier; receive a message indicating initiation of a parking event at a parking location, and update a parking database to indicate that a vehicle having the vehicle identifier is parked at the parking location. The message includes an identification of at least one of the payment source and the vehicle identifier.

In another aspect of the invention, there is a method of deploying a system for parking management. The method includes providing a computer infrastructure, that operates to: associate a user with a vehicle; receive a message indicating a current location of the vehicle; determine available parking spots within a predefined area around the current location of the vehicle; and transmit a message indicating the determined available parking spots to the user.

In another aspect of the invention, there is a system implemented in hardware and comprising a computing device including a parking manager application. The system operates to: associate a payment source with a vehicle identifier; receive an identification of at least one of the payment source and the vehicle identifier when a parking event is initiated at a parking location; and update a parking database to indicate that a vehicle having the vehicle identifier is parked at the parking location.

In an additional aspect of the invention, a computer program product comprising a computer usable storage medium having readable program code embodied in the medium is provided. The computer program product includes at least one component operable to: associate a payment source with a vehicle identifier, and receive a message indicating initiation of a parking event at a parking location. The message includes an identification of at least one of the payment source and the vehicle identifier. The at least one component is also operable to determine a price for parking at the parking location based on at least one of: features of a vehicle having the vehicle identifier, time of day, weather, promotions or subsidies, and convenience of the parking location; display the determined price to a user of the vehicle during the initiation of the parking event; and update a parking database to indicate that the vehicle is parked at the parking location. The vehicle identifier comprises a license plate number or vehicle identification number (VIN) of the vehicle. The payment source comprises one of: a credit card, a debit card, and a prepaid funds card. The message indicates a specified duration of the parking event. The updating the parking database comprises updating the parking database to reflect the specified duration of the parking event.

In a further aspect of the invention there is a computer system for parking management, the system comprises a CPU, a computer readable memory and a computer readable storage media. Additionally, the system comprises first program instructions to associate a payment source with a vehicle identifier; second program instructions to receive data defining of at least one of the payment source and the vehicle identifier when a parking event is initiated at a parking location; and third program instructions to update a parking database to indicate that a vehicle having the vehicle identifier is parked at the parking location. The first, second, and third program instructions are stored on the computer readable storage media for execution by the CPU via the computer readable memory.

BRIEF DESCRIPTION OF THE SEVERAL VIEWS OF THE DRAWINGS

The present invention is described in the detailed description which follows, in reference to the noted plurality of drawings by way of non-limiting examples of exemplary embodiments of the present invention.

DETAILED DESCRIPTION

Figure 1A:
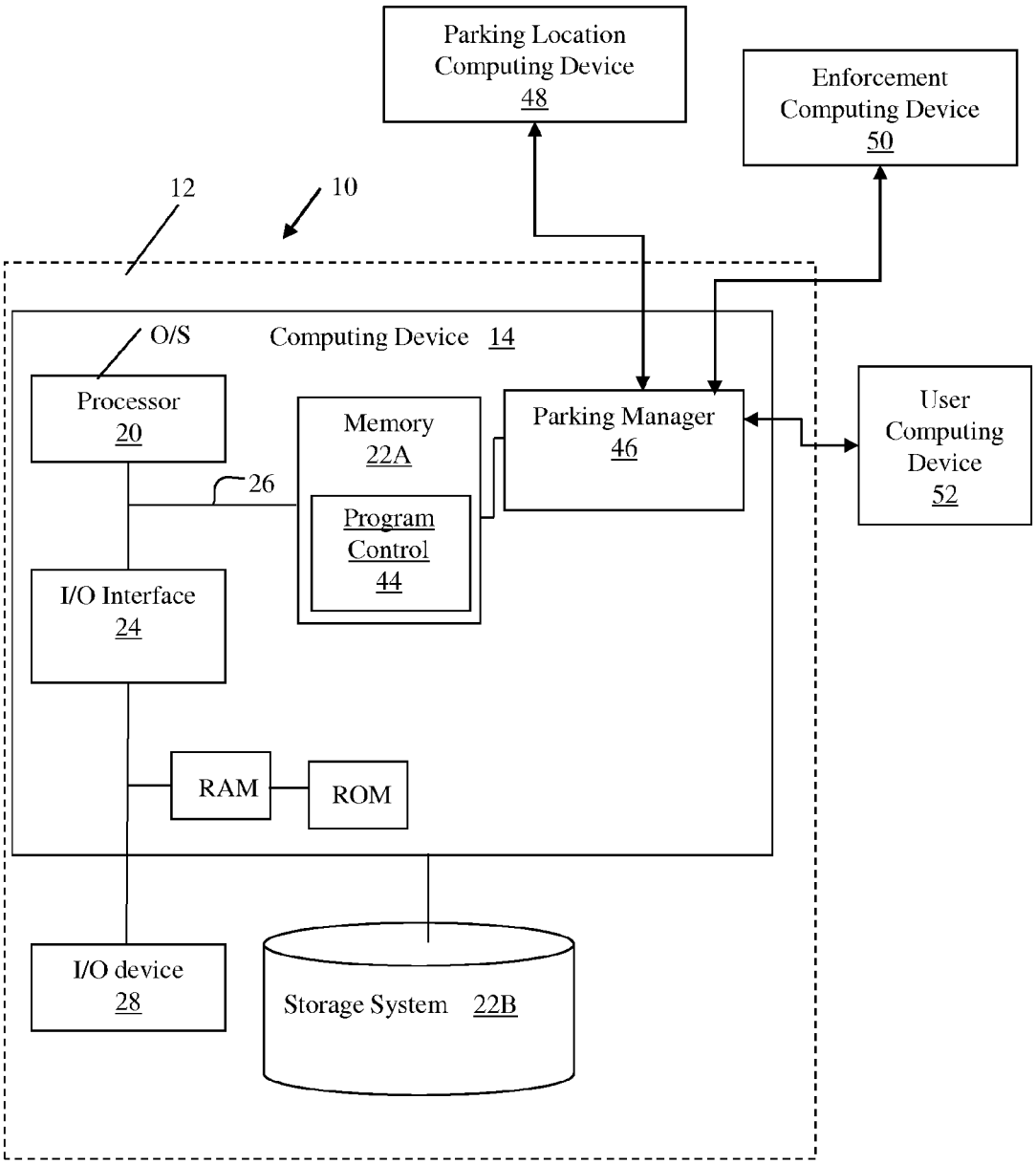
FIG. 1*a* shows an illustrative environment for implementing the steps in accordance with aspects of the invention.

The present invention generally relates to parking management and, more particularly, to methods and systems for enhanced parking management involving linking a payment source to a vehicle identifier. The methods and systems described herein provide for payment and enforcement without the use of paper receipts. According to aspects of the invention, a vehicle identifier (such as a license plate, vehicle identification number (VIN), etc.) is associated with a payment source (such as a credit card, debit card, prepaid funds card, etc.), and the association is stored in a computing system. When the patron initiates a parking event, funds are deducted from the payment source and the computing system is updated to reflect that the vehicle associated with the payment source has paid for parking at a specified location for a specified duration. Parking enforcement may be performed by detecting the vehicle identifier of a vehicle parked in a parking spot and querying the computing system to determine whether this particular vehicle has paid for parking. In this manner, the payment and enforcement of parking may be performed using the computing system and without the use of paper receipts.

Additional features are provided in accordance with further aspects of the invention. In embodiments, a user is provided with the ability to reserve a parking spot prior to arriving at the location of the parking spot. In further embodiments, the system may detect available parking spots and transmit a message to a user indicating the location of the available parking spots. The available parking spots presented to a user may be filtered and/or ranked based on predefined user preferences and/or observed historical data. In even further embodiments, a notification is transmitted to a user whose paid-for time in a parking spot is about to expire. The notification may include an option for the user to purchase additional parking time. In still further embodiments, the price of a parking spot may be varied by the system based parameters such as, for example, location of the parking spot, type or category of the parking spot, time of day, historical demand for this location, historical demand for this type or category, etc.

System Environment

As will be appreciated by one skilled in the art, aspects of the present invention may be embodied as a system, method or computer program product. Accordingly, aspects of the present invention may take the form of an entirely hardware embodiment, an entirely software embodiment (including firmware, resident software, micro-code, etc.) or an embodiment combining software and hardware aspects that may all generally be referred to herein as a "circuit," "module" or "system." Furthermore, aspects of the present invention may take the form of a computer program product embodied in one or more computer readable medium(s) having computer readable program code embodied thereon.

Any combination of one or more computer readable medium(s) may be utilized. The computer readable medium may be a computer readable signal medium or a computer readable storage medium. A computer readable storage medium may be, for example, but not limited to, an electronic, magnetic, optical, electromagnetic, infrared, or semiconductor system, apparatus, or device, or any suitable combination of the foregoing. More specific examples (a non-exhaustive list) of the computer readable storage medium would include the following: an electrical connection having one or more wires, a portable computer diskette, a hard disk, a random access memory (RAM), a read-only memory (ROM), an erasable programmable read-only memory (EPROM or Flash memory), an optical fiber, a portable compact disc read-only memory (CD-ROM), an optical storage device, a magnetic storage device, or any suitable combination of the foregoing. In the context of this document, a computer readable storage medium may be any tangible medium that can contain, or store a program for use by or in connection with an instruction execution system, apparatus, or device.

A computer readable signal medium may include a propagated data signal with computer readable program code embodied therein, for example, in baseband or as part of a carrier wave. Such a propagated signal may take any of a variety of forms, including, but not limited to, electromagnetic, optical, or any suitable combination thereof. A computer readable signal medium may be any computer readable medium that is not a computer readable storage medium and that can communicate, propagate, or transport a program for use by or in connection with an instruction execution system, apparatus, or device.

Program code embodied on a computer readable medium may be transmitted using any appropriate medium, including but not limited to wireless, wireline, optical fiber cable, RF, etc., or any suitable combination of the foregoing.

Computer program code for carrying out operations for aspects of the present invention may be written in any combination of one or more programming languages, including an object oriented programming language such as Java, Smalltalk, C++ or the like and conventional procedural programming languages, such as the "C" programming language or similar programming languages. The program code may execute entirely on the user's computer, partly on the user's computer, as a stand-alone software package, partly on the user's computer and partly on a remote computer or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider).

Aspects of the present invention are described below with reference to flowchart illustrations and/or block diagrams of methods, apparatus (systems) and computer program products according to embodiments of the invention. It will be understood that each block of the flowchart illustrations and/or block diagrams, and combinations of blocks in the flowchart illustrations and/or block diagrams, can be implemented by computer program instructions. These computer program instructions may be provided to a processor of a general purpose computer, special purpose computer, or other programmable data processing apparatus to produce a machine, such that the instructions, which execute via the processor of the computer or other programmable data processing apparatus, create means for implementing the functions/acts specified in the flowchart and/or block diagram block or blocks.

These computer program instructions may also be stored in a computer readable medium that can direct a computer, other programmable data processing apparatus, or other devices to function in a particular manner, such that the instructions stored in the computer readable medium produce an article of manufacture including instructions which implement the function/act specified in the flowchart and/or block diagram block or blocks.

The computer program instructions may also be loaded onto a computer, other programmable data processing apparatus, or other devices to cause a series of operational steps to be performed on the computer, other programmable apparatus or other devices to produce a computer implemented process such that the instructions which execute on the computer or other programmable apparatus provide processes for implementing the functions/acts specified in the flowchart and/or block diagram block or blocks.

FIG. 1*a* shows an illustrative environment 10 for managing the processes in accordance with the invention. In embodiments, the environment 10 is comprised in a central parking system. To this extent, the environment 10 includes a server or other computing system 12 that can perform the processes described herein. In particular, the server 12 includes a computing device 14. The computing device 14 can be resident on a network infrastructure or computing device of a third party service provider (any of which is generally represented in FIG. 1*a*).

The computing device 14 also includes a processor 20, memory 22A, an I/O interface 24, and a bus 26. The memory 22A can include local memory employed during actual execution of program code, bulk storage, and cache memories which provide temporary storage of at least some program code in order to reduce the number of times code must be retrieved from bulk storage during execution. In addition, the computing device includes random access memory (RAM), a read-only memory (ROM), and an operating system (O/S).

The computing device 14 is in communication with the external I/O device/resource 28 and the storage system 22B. For example, the I/O device 28 can comprise any device that enables an individual to interact with the computing device 14 (e.g., user interface) or any device that enables the computing device 14 to communicate with one or more other computing devices using any type of communications link. The external I/O device/resource 28 may be for example, a handheld device, PDA, handset, keyboard etc.

In general, the processor 20 executes computer program code (e.g., program control 44), which can be stored in the memory 22A and/or storage system 22B. Moreover, in accordance with aspects of the invention, the program control 44 controls a parking manager 46 that performs one or more of the processes described herein. The parking manager 46 can be implemented as one or more program code in the program control 44 stored in memory 22A as separate or combined modules. Additionally, the parking manager 46 may be implemented as separate dedicated processors or a single or several processors to provide the function of this tool. While executing the computer program code, the processor 20 can read and/or write data to/from memory 22A, storage system 22B, and/or I/O interface 24. The program code executes the processes of the invention. The bus 26 provides a communications link between each of the components in the computing device 14.

In accordance with aspects of the invention, a central parking system comprises the computing device 14 and the parking manager 46. The parking system coordinates registration, parking, and enforcement activities. The parking system may be TCP/IP based and utilize systems such as relational databases for storage of data related to registration, parking, and enforcement. For example, the parking system may store registration data including vehicle identifier data and payment source associated with a vehicle. Upon initiation of a parking event, the parking system stores data indicating that a particular registered vehicle has reserved parking in a specific location for a specified duration. The parking system may also be accessed by enforcement officers to verify that a vehicle is validly parked in a spot.

More specifically, in accordance with aspects of the invention, the computing device 14 of the parking system stores and maintains registration data that defines associations between vehicle identifiers and payment sources. The registration data may be stored in, for example, a relational database in the storage system 22B. In embodiments, the computing device 14 also stores and maintains data associated with (e.g., identifying) at least one parking spot, and preferably a plurality of parking spots arranged in one or more parking locations and/or facilities. This data may also be stored in, for example, a same or different relational database in the storage system 22B.

In implementations, the parking manager 46 of the computing device 14 receives a notification from a parking location computing device 48 that payment for parking has been made from a payment source associated with a vehicle identifier. The parking location computing device 48 may be any computing device comprising any combination of hardware and software and/or firmware that is capable of: receiving input from a parking patron that the patron intends to park their vehicle at a parking spot, location, or facility; obtaining or receiving data indicating the vehicle identifier and/or the payment source associated with the patron; and transmitting the notification of payment to the computing device 14. The notification of payment may include a duration of paid-for parking and a parking location for which the payment was made, and may further include the vehicle identifying data (e.g., license plate number, VIN, etc.). In embodiments, the parking manager 46 updates stored data to reflect the notification of payment, including the vehicle identifier and duration associated with the notification, and the location of the parking spot.

In embodiments, the computing device 14 communicates electronically with at least one enforcement computing device 50. The enforcement computing device 50 may be any computing device comprising any combination of hardware and software and/or firmware that is capable of: transmitting vehicle identifier data to the computing device 14, receiving a subsequent related transmission from the computing device 14, and indicating to a user of the enforcement computing device 50 whether the vehicle identifier data corresponds to a validly parked (e.g., currently paid for parking in this location) vehicle.

In further embodiments, the computing device 14 communicates electronically with at least one user computing device 52. The user computing device 52 may be a smart phone, personal digital assistant (PDA), laptop computer, notebook or netbook computer, tablet computer, vehicle navigation computer, or any other personal wireless computing device. In implementations, the parking manager 46 provides an indication of available parking spots to the user via the user computing device 52. The user may also use the user computing device 52 to reserve an available parking spot, as described in greater detail herein. The computing device 14, and particularly the parking manager 46, may be configured to perform other processes in accordance with aspects of the invention as described in greater detail herein.

In some embodiments, a single computing device 14 (including the parking manager 46) is associated with and manages plural different parking locations. Each parking location (e.g., parking garage, parking lot, metered curb-side parking spots) may comprise a respective parking location computing device 48. In this manner, the computing device 14 manages parking at plural different physical locations.

In other embodiments, a single parking location may comprise a computing device 14, including the parking manager 46, and a parking location computing device 48. In such embodiments, the computing device 14 and parking location computing device 48 may be different devices, or may be integrated in a single computing device.

The computing device 14 can comprise any general purpose computing article of manufacture capable of executing computer program code installed thereon (e.g., a personal computer, server, etc.). However, it is understood that the computing device 14 is only representative of various possible equivalent-computing devices that may perform the processes described herein. To this extent, in embodiments, the functionality provided by the computing device 14 can be implemented by a computing article of manufacture that includes any combination of general and/or specific purpose hardware and/or computer program code. In each embodiment, the program code and hardware can be created using standard programming and engineering techniques, respectively.

Similarly, the computing infrastructure 12 is only illustrative of various types of computer infrastructures for implementing the invention. For example, in embodiments, the server 12 comprises two or more computing devices (e.g., a server cluster) that communicate over any type of communications link, such as a network, a shared memory, or the like, to perform the process described herein. Further, while performing the processes described herein, one or more computing devices on the server 12 can communicate with one or more other computing devices external to the server 12 using any type of communications link. The communications link can comprise any combination of wired and/or wireless links; any combination of one or more types of networks (e.g., the Internet, a wide area network, a local area network, a virtual private network, etc.); and/or utilize any combination of transmission techniques and protocols.

Figure 1B:
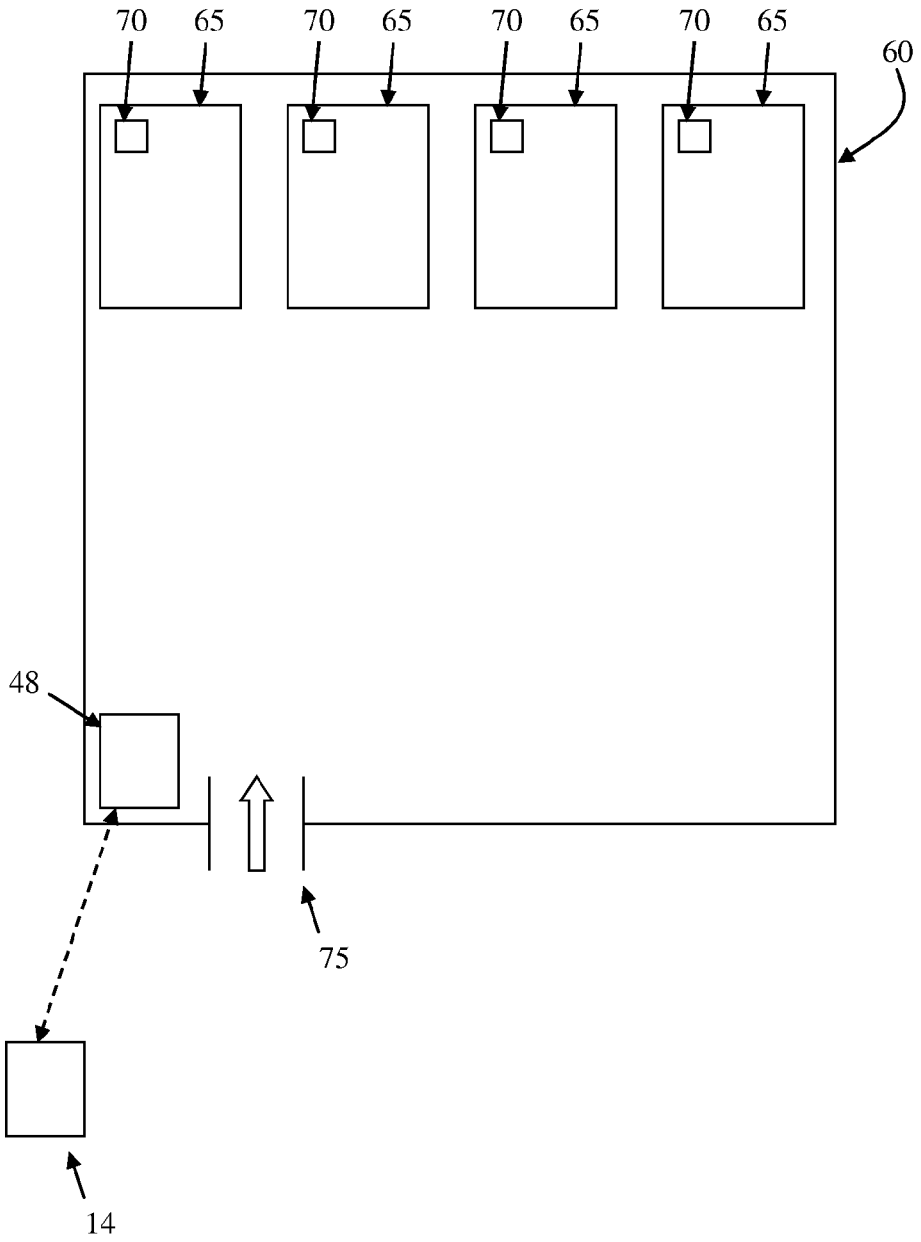
FIG. 1*b* shows an illustrative system in accordance with aspects of the invention.

FIG. 1*b* shows an illustrative system in accordance with aspects of the invention. In particular, FIG. 1*b* shows a parking location 60 comprising a plurality of parking spots 65. Each parking spot 65 may be provided with a sensor 70 that detects the presence of a vehicle in the parking spot 65. The sensor 70 may be any desired sensor, such as a radar, laser, or weight sensor, or other suitable proximity sensor that is configured to determine when a vehicle occupies the parking spot 65 and when the parking spot 65 is empty.

In embodiments, the parking location 60 includes a parking location computing device 48, such as that described with respect to FIG. 1*a*. In but one example, the parking location computing device 48 may be located near an entrance 75 of the parking location 60 to enable patrons to utilize their payment source at the parking location computing device 48 to gain access to the parking location 60. In implementations, the parking location computing device 48 communicates with the central parking system comprising the computing device 14, as described herein. Moreover, the sensors 70 may communicate with one or both of the parking location computing device 48 and the computing device 14. The sensors 70 may be used to detect when a vehicle leaves a parking spot, which may be used to determine the end of a parking event and/or unauthorized use of the vehicle.

Flow Diagrams

FIGS. 2-5 show exemplary block diagrams and/or process flows for performing aspects of the present invention. The steps of FIGS. 2-5 may be implemented in the environment of FIGS. 1*a* and/or 1*b*, for example.

The flowcharts and block diagrams in the Figures illustrate the architecture, functionality, and operation of possible implementations of systems, methods and computer program products according to various embodiments of the present invention. In this regard, each block in the flowchart or block diagrams may represent a module, segment, or portion of code, which comprises one or more executable instructions for implementing the specified logical function(s). It should also be noted that, in some alternative implementations, the functions noted in the block may occur out of the order noted in the figures. For example, two blocks shown in succession may, in fact, be executed substantially concurrently, or the blocks may sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts, or combinations of special purpose hardware and computer instructions.

Furthermore, the invention can take the form of a computer program product accessible from a computer-usable or computer-readable medium providing program code for use by or in connection with a computer or any instruction execution system. The software and/or computer program product can be implemented in the environment of FIGS. 1*a* and/or 1*b*. For the purposes of this description, a computer-usable or computer readable medium can be any apparatus that can contain, store, communicate, propagate, or transport the program for use by or in connection with the instruction execution system, apparatus, or device. The medium can be an electronic, magnetic, optical, electromagnetic, infrared, or semiconductor system (or apparatus or device) or a propagation medium. Examples of a computer-readable storage medium include a semiconductor or solid state memory, magnetic tape, a removable computer diskette, a random access memory (RAM), a read-only memory (ROM), a rigid magnetic disk and an optical disk. Current examples of optical disks include compact disk-read only memory (CD-ROM), compact disc-read/write (CD-R/W) and DVD.

Figure 2:
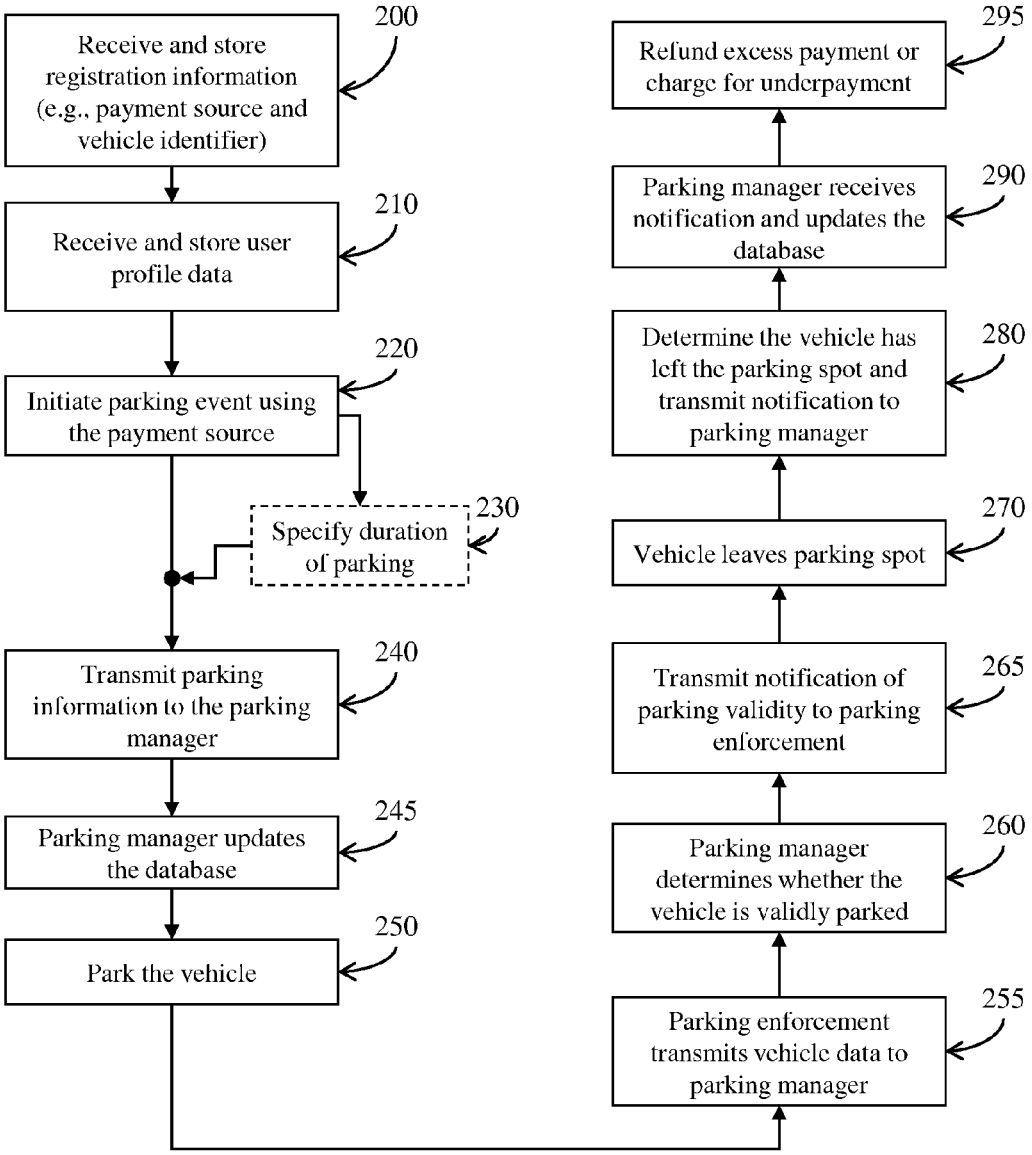
FIGS. 2-5 show exemplary block diagrams and/or process flows in accordance with aspects of the invention.

FIG. 2 depicts an exemplary flow for a process in accordance with aspects of the present invention. At step 200, the parking system (e.g., computing device 14 and parking manager 46) receives and stores user registration information. In embodiments, step 200 includes the parking system receiving and/or obtaining data defining a payment source and a vehicle identifier associated with the registered vehicle, and storing this data such that the payment source is associated with the vehicle identifier.

In accordance with aspects of the invention, the payment source may be any source through which funds (e.g., money) may be transferred directly or indirectly from the user to the parking system for payment for parking. For example, the payment source may include any of: a credit card, a debit card, a prepaid funds card, a checking account, a savings account, a prepaid funds account maintained by the parking system or a third party. The invention is not limited to these payment sources, and any suitable payment sources may be used within the scope of the invention.

In accordance with further aspects of the invention, the vehicle identifier may comprise any suitable data that uniquely identifies a particular vehicle. For example, the vehicle identifier may include any of: a license plate number, a vehicle identification number, a unique code associated with an RFID tag, a unique printed bar code, etc. The invention is not limited to these vehicle identifiers, and any vehicle identifiers sources may be used within the scope of the invention.

The data defining a payment source and a vehicle identifier may be received and/or obtained by the parking system in any suitable manner. A user may, for example, physically mail a registration application including a credit card number and license plate number (or VIN) to an entity (e.g., processing center) associated with the parking system, and this data may be electronically entered into the parking system. Additionally, a user may submit their credit card number and license plate number (or VIN) to the parking system electronically, e.g., via email, text message, phone call, or website. In both of these examples, the parking system stores the payment source data (e.g., credit card number) and the vehicle identifier data (e.g., license plate number or VIN), and also defines and stores an association between these two data. The data may be stored in any suitable manner, such as in a database, preferably a relational database (e.g., stored in storage system 22B).

The invention is not limited to these examples for the parking system receiving data defining a payment source and a vehicle identifier. In embodiments, the user may provide data defining the payment source, and may be provided with a unique vehicle identifier. For example, the user may physically mail or electronically transmit their payment source information (e.g., credit card number) to the parking system and be provided with an RFID tag or printed bar code having a unique code. In such implementations, the parking system stores the user payment information and data defining the RFID tag or bar code, and also defines and stores an association between the two.

In a particular exemplary embodiment, a user may provide their data defining a payment source and a vehicle identifier at an automated kiosk associated with the parking system. The kiosk may comprise a credit card reader and a user interface, such as a touch-screen graphical user interface and/or a physical keypad. The user may enter or swipe their credit card in the credit card reader of the kiosk. The user may enter their license plate number (or VIN) using the kiosk user interface. The kiosk may provide this payment source and vehicle identifier data to the parking system (e.g., computing device 14 and parking manager 46), which stores the payment source and vehicle identifier data and also defines and stores an association between the payment source and vehicle identifier data. The kiosk may be a drive-up and/or walk-up kiosk.

In yet another exemplary embodiment, the kiosk may dispense an RFID tag or bar code to the user once the user has provided their payment source information. As such, rather than providing their license plate number (or VIN), the user only provides payment source information, and is provided with a vehicle identifier in the form of an RFID tag or printed bar code that can be affixed to the user's vehicle.

In an even further exemplary embodiment, the user may access the kiosk while sitting in their vehicle (e.g., a drive-up kiosk), and the kiosk may automatically obtain the vehicle identifier data. For example, a user may drive their vehicle to a kiosk and, while sitting in their vehicle, enter their payment source information (e.g., with a credit card reader or other suitable manner). The kiosk may comprise a camera that captures an image of the license plate of the vehicle in which the user is sitting while interacting with the kiosk. The kiosk may determine the license plate number from the captured image using any suitable technique, such as optical character recognition software. In this manner, the kiosk automatically obtains the vehicle identifier data. The kiosk then provides the user payment source data and the obtained vehicle identifier data to the parking system, and the parking system stores and associated this data as already described herein.

At step 210, the parking system (e.g., computing device 14 and parking manager 46) optionally receives and stores user profile data. The user profile data may be received by the parking system in any suitable manner, such as by receipt of an electronic questionnaire that has been answered and submitted by the user. In embodiments, the user profile data is associated with the payment source data and the vehicle identification data for the particular user. In accordance with aspects of the invention, the user profile data may be utilized by the parking system in providing additional features as described in greater detail herein.

Any suitable data may be received and stored as the user profile data. In embodiments, the user profile data may include, but is not limited to: user identification information, such as name and address; authentication information, such as a password; user contact information (e.g., mobile telephone number, email address, etc.) to which parking-related notifications can be sent; device identifier for a global positioning system (GPS) device associated with the user and/or registered vehicle; user preference for cost of a parking spot (e.g., more expensive or less expensive) versus convenience of the parking spot (e.g., covered or uncovered, proximity to pedestrian ingress/egress points, proximity to landmarks, etc.); emergency contact information (e.g., mobile telephone number, email address, etc.) to which emergency notifications can be sent; parameters defining when an emergency notification should be sent; pre-recorded emergency notification(s); qualifications/certifications associated with the vehicle (e.g., the vehicle is certified for use as a high-occupancy carpool vehicle, the vehicle is authorized to park in handicapped parking spots, etc.); and information related to the registered vehicle, such as, make and model, type of propulsion system (e.g., gasoline, diesel, natural gas, hybrid, electric, etc.), size (e.g., gross vehicle weight, number of axles. etc.), and any other desired information.

At step 220, a user (e.g., parking patron) initiates parking their registered vehicle using a payment source that is linked to (e.g., associated with) the registered vehicle. In embodiments, this may comprise a user swiping or inserting a payment card (e.g., credit card, debit card, prepaid card, etc.) in an electronic card reader included in a parking location computing device (e.g., parking location computing device 48 from FIG. 1*a*) at a point of entry into a parking facility, at parking meter associated with a single parking spot, or at a kiosk associated with a plurality of parking spots. As another, example, step 220 may comprise the user passing a hand-held RFID tag in front of an RFID reader at the point of entry into a parking facility. In another example, step 220 includes equipment at the point of entry into the parking facility automatically detecting an RFID tag or bar code that is affixed to the user's vehicle, such as by using an RFID reader or bar code reader appropriately positioned at the point of entry to make such a reading. In an example of a metered parking space, such as along a street, as opposed to a restricted access facility such as a garage or lot, step 220 may include the user swiping or inserting their payment card or RFID tag at an electronic reader at a parking meter associated with the metered parking spot or a kiosk associated with a plurality of parking spaces.

At step 230, the user optionally specifies a duration for the parking that was initiated at step 220. Step 230 may additionally optionally comprise informing the user of rates (e.g., price) and restrictions (e.g., time limits) for parking at the present location (e.g., parking garage, parking lot, metered parking spot, etc.). For example, the user may be presented with a graphical user interface on a display screen of the parking location computing device. The graphical user interface may provide the user with the option to specify a time duration of parking at the present location. The graphical user interface may additionally optionally present the user with parking rates (e.g., prices) at the present location prior to, or concurrently with, presenting the user with the option to specify a time duration of parking. The graphical user interface may additionally optionally present the user with any restrictions associated with parking at the present location, such as parking time duration limits, etc. In this manner, the user may be provided with information to make an informed decision about parking at the present location. The parking location computing device that presents the graphical user interface to the user may additionally comprise a component for receiving input from the user, such as at least one of a touch screen, keypad, buttons, etc.

At step 240, the parking location computing device transmits the parking information from step 220 and optionally step 230 (e.g., payment source and/or vehicle identifier, specified duration, parking location) to the parking manager (e.g., parking manager 46 from FIG. 1*a*). In accordance with aspects of the invention, the payment card, RFID tag, or bar code used by the patron to initiate parking at step 220 is the payment source, or is associated with the payment source, described above with respect to step 200. Moreover, as already described herein, the vehicle identifier (e.g., license plate, VIN, etc.) is associated with the payment source. As such, in embodiments, the parking location computing device at the parking location obtains information from the payment source used to initiate the parking, and transmits the payment source data and/or vehicle identifier data, as well as the parking location, to the parking manager. When a duration is specified by the user at optional step 230, data indicating the specified duration is also provided to the parking manager by the computer equipment at the parking facility. In this manner, the parking manager may receive a message that a particular vehicle is parked at a particular location for a specified duration, and this information may be used by the parking manager in association with other aspects of the invention including, but not limited to, parking enforcement, parking termination, and notifications to the user, as described in greater detail herein.

At step 245, the parking manager updates a database with information received at step 240. In embodiments, the parking manager stores data indicating the identity of the parked vehicle, the location of the parked vehicle, the time the parking began, and optionally an amount of parking time paid for or specified at steps 220 and 230.

At step 250, the user parks the vehicle in the appropriate parking spot. The parking spot in which the vehicle is parked may be an assigned spot that may be selected by the user or specified by the parking location computing device at step 220. Alternatively to parking in a particular specified spot, the user may be permitted to park in one of a plurality of available spots associated with this parking location. Although depicted after step 245 in FIG. 2, step 250 may alternatively occur at various times throughout the process after step 220, such as prior to step 240, prior to step 245, or concurrently with either of steps 240 and 245.

In accordance with aspects of the invention, parking enforcement officials may use data maintained by the parking manager (e.g., parking manager 46) to enforce parking rules, requirements, regulations, etc. For example, at step 255, a parking enforcement official who wishes to discern whether a vehicle is validly parked transmits vehicle identification data to the parking manager. In embodiments, the parking enforcement official enters the vehicle identification data of the parked vehicle into an enforcement computing device (e.g., enforcement computing device 50 from FIG. 1*a*) that transmits the vehicle identification data to the parking manager. The enforcement computing device may comprise a hand-held wireless computing device that wirelessly transmits the vehicle identification data to the parking manager. For example, at step 255, the parking enforcement official may manually enter (e.g., key in) the vehicle license plate number or VIN of a parked vehicle to the enforcement computing device, and the enforcement computing device transmits this data to the parking manager. Optionally, the enforcement computing device may automatically gather the vehicle identifier, such as by capturing an image of the license plate or VIN of a parked vehicle and using optical character recognition software to resolve the license plate or VIN.

At step 260, the parking manager determines whether the vehicle identified at step 255 is validly parked. In embodiments, the parking manager compares the vehicle identifier received at step 255 to stored payment data associated with the vehicle identifier (e.g., data from steps 240 and 245). For example, at step 260, the parking manager may examine the data from step 240 to determine whether the vehicle identified at step 255 has paid to park at the specified location. Moreover, at step 260 the parking manager may additionally determine whether the vehicle identified at step 255 has exceeded a paid for time duration to park at the specified location.

Still at step 265, after determining that the vehicle identified at step 255 is either validly parked (e.g., has paid for parking at this location) or not validly parked (e.g., has not paid for parking at this location or has paid but exceeded a paid for duration), the parking manager transmits a message to the parking enforcement official indicating the parking status of the vehicle. In embodiments, the parking manager wirelessly transmits a return message to the enforcement computing device that the parking enforcement official used for entering the vehicle identifier at step 255. The return message may be any suitable type of notification that the vehicle is validly parked or not, such as a text message, email, or other data communication.

In an additional mode related to enforcement, a meter or kiosk that was accessed by the user at step 220 may poll the parking manager to determine whether the paid-for parking time has expired. The meter or kiosk may transmit such a polling a message to the parking manager in any suitable format over any desired communication network. In embodiments, the parking manager examines the data stored in the database and determines whether the vehicle has exceeded the paid for parking time and transmits a return message to the meter or kiosk. The return message indicates that the parked vehicle either has not exceeded the paid-for time or has exceeded the paid for time. In the case where the parking manager indicates that the vehicle has exceeded the paid for time, the meter or kiosk, upon receipt of such a message, may visually indicate via a display element that the parked vehicle has exceeded its paid-for parking duration. A parking enforcement official may use this visual indicator to quickly and efficiently identify invalidly parked vehicles.

At step 270, the parked vehicle leaves the parking spot. For example, a user moves the vehicle (e.g., the vehicle from step 220) out of the parking spot. At step 280, a sensor (e.g., sensor 70) or other device detects that the vehicle has left the parking spot. For example, the parking spot may be equipped with a sensor such as a radar, laser, weight sensor, or other suitable proximity sensor that is configured to determine when a vehicle occupies the parking spot and when a vehicle leaves the parking spot. In embodiments, the sensor is operatively connected to the parking location computing device that, upon detection by the sensor, transmits a notification to the parking manager that the vehicle has left the parking spot. In further embodiments and based on the detection by the sensor, the parking location computing device or the parking manager transmits a message to the user computing device (e.g., device 52) indicating that the vehicle has left the parking spot. This information may be used to detect unauthorized use of the vehicle At step 290, the parking manager receives the notification of step 280 and updates the database to indicate that the particular spot is now vacant. Optionally, at step 295 the parking manager refunds the user's payment source for excess paid-for parking time (e.g., overpayment), or charges the user's payment source for additionally used parking time for which payment has not been received (e.g., underpayment). In embodiments, the parking manager compares the amount of parking time paid for (e.g., at step 220 and, optionally at step 230) to the amount of time actual used in the parking spot, and credits (e.g., refund) the user's payment source for any excess payment (e.g., the user paid for more parking time than was actually used) or additionally charges the user's payment source for any deficiencies (e.g., the user paid for less parking time than was actually used).

Alternatively to using sensors at step 280, the system may determine that the vehicle has left the parking spot when the user swipes or inserts their payment card, RFID tag, or bar code at a reader included in a parking location computing device at an exit point of the parking facility. For example, in a parking garage or parking lot embodiment, the garage or lot may be provided with a reader at the entrance point and the exit point. The user swipes or inserts their payment card, RFID tag, or bar code at the entrance point when entering the garage or lot, and subsequently swipes or inserts their payment card, RFID tag, or bar code at the exit point when exiting the garage or lot. The parking manager may determine the actual time the vehicle was in the garage or lot based on the data associated with the entrance and exit. This actual time may be used at step 290 for updating the database and optionally at step 295 for refunding or additionally charging the user's payment source based on the previously paid for parking time.

In other embodiments, at step 280, rather than the system detecting that a vehicle has vacated a parking spot or facility (e.g., with sensors or tracking entrances and exits, as described above), the system may determine that the vehicle has left the parking spot by receiving a message from the user that the parking event is being terminated. For example, the user may enter their payment source or vehicle identifier into a kiosk to indicate that they are vacating the parking spot (or garage or lot) associated with that vehicle. As another example, the user may send a message to the parking manager via a web browser indicating that they have vacated the parking spot. In a further example, a user may send a text message having a predefined format from a registered phone device to the parking manager indicating that they have vacated the parking spot. Any of these types of messaging may be used to notify the parking manager that the vehicle has vacated the parking spot, and the parking manager may use this information at step 290 for updating the database and optionally at step 295 for refunding or additionally charging the user's payment source.

Figure 3:
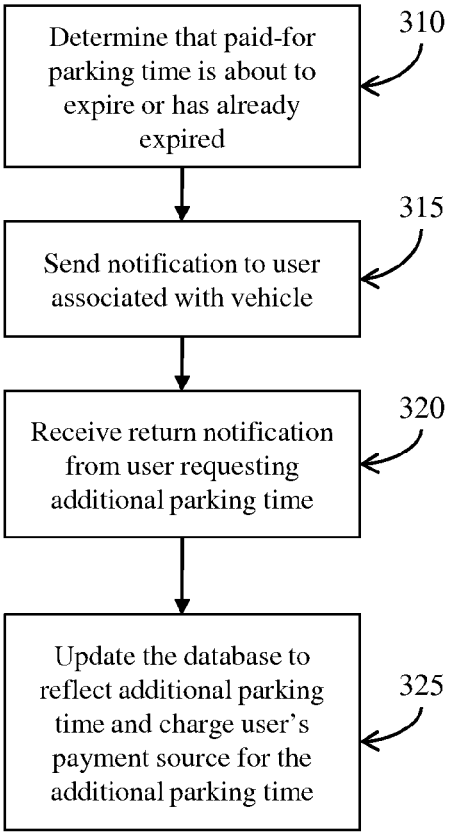

In accordance with further aspects of the invention, the parking manager (e.g., parking manager 46) may send notifications to the parking patron. FIG. 3 depicts an exemplary process flow for sending notifications in accordance with aspects of the invention. At step 310, the parking manager determines that a parked vehicle is about to exceed (or has exceeded) the paid-for or specified parking time, for example, by comparing the paid-for or specified parking time from step 220 and/or 230 to an actual time spent in the parking spot. A predetermined threshold, such as, for example, five, ten, or fifteen minutes, or any other desired amount of time prior to expiration of the paid-for parking time, may be used as the basis for determining that the parked vehicle is about to exceed the paid-for or specified parking time.

At step 315, the parking manager sends a notification to the user indicating that the paid-for time is about to expire (or has expired). In embodiments, the message is transmitted from the parking manager to a communication device (e.g., phone, computer, etc.) specified by the user in the contact information described above with respect to step 210. The message may have any suitable form, such as a text message, email, recorded audio message, etc. The notification at step 315 may provide the user with an option to purchase more parking time.

At step 320, the user may send a return notification to the parking manager to extend the paid for parking time in exchange for an additional charge to the user's payment source. The return notification may take any suitable form, such as a text message, email, voice or key command in an automated menu, etc.

At step, 325, the parking manager receives the return notification, updates the database to reflect any additional parking time, and charges the user's payment source for the additional parking time. The parking manager may optionally send a notification back to the user indicating that the parking time has been extended and the amount charged to their payment source for the extension.

In accordance with even further aspects of the invention, the parking system may be configured to issue an emergency notification to the user. For example, a user may specify a maximum parking time in the profile data (e.g., from step 210). When the parking manager determines that the user's registered vehicle has been parked in a location for more than the maximum time, the parking manager may send a predefined message to a communication device (e.g., telephone, computer, etc.) specified by the user in the contact information at step 210. The predefined message may take any desired form, such as a text message, email, or prerecorded audio message, and may be specified by the user in the profile data or may be a default message provided by the system.

In embodiments, the parking system may be configured to provide variable pricing for parking spots. For example, a particular parking spot may have a first price for parking at a first time based on a first set of factors, and a different second price for parking at a second time based on a second set of factors. The parking manager (e.g., parking manager 46) may be programmed to take any desired factors into account when determining the price for a parking spot. These factors may include, but are not limited to, features of the registered vehicle, promotions or subsidies, time of day, weather, and relative convenience of the parking spot, as described in greater detail below.

Figure 4:
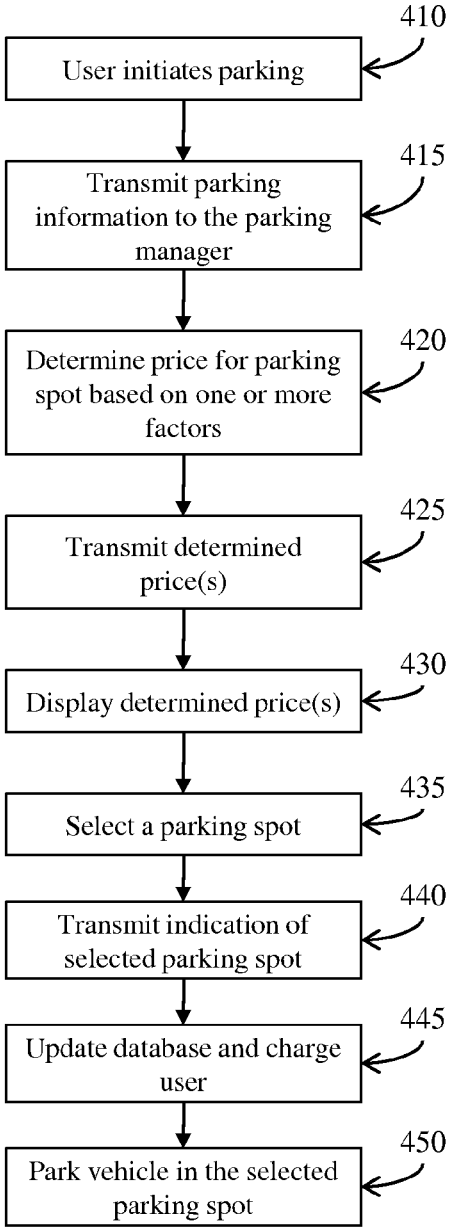

FIG. 4 shows an exemplary process flow in accordance with aspects of the invention for providing variable pricing for one or more parking spots. At step 410, a user initiates a parking event at a parking location with their registered payment source. Step 410 may be performed in a manner similar to step 220 describe above with respect to FIG. 2.

At step 415, the parking location computing device (e.g., parking location computing device 48) transmits the parking information (e.g., payment source and/or vehicle identifier, parking location, etc.) to the parking manager (e.g., parking manager 46). Step 415 may be performed in a manner similar to step 240.

At step 420, the parking manager determines the current price for at least one parking spot at the parking location where the user initiated the parking event (e.g., at step 410) based on at least one factor. In embodiments, the parking manager is provided with data (or programmed to access data from another source) that relates parking price to factors. The factors may include, but are not limited to, features of the registered vehicle, time of day, weather, promotions or subsidies, and relative convenience of the parking spot.

For example, the price for a particular parking spot may be adjusted (e.g., discounted, reduced by a predetermined amount, etc.) based on the make and model of the vehicle parking. As noted above, the user profile data may include information defining features of the registered vehicle, such as a make and model of the vehicle. The parking manager can access the user profile data associated with the vehicle initiating the parking (e.g., at step 410) based on the payment source data or vehicle identifier. In embodiments, the parking manager is also provided with or has access to a list of makes and models of vehicles that qualify for discounted parking prices, as well as the amount of any such discount. In implementations, the parking manager is programmed to determine from this data whether the vehicle initiating the parking (e.g., at step 410) qualifies for a discounted price based on the make and model of their vehicle, and to apply this discount when determining a parking rate for the vehicle initiating parking.

In another implementation, the price for a particular parking spot may be adjusted based on the time of day. For example, the price of a parking spot may be designated at a first price during a first time period, such as peak business hours (e.g., 8:00 AM to 4:00 PM). The price of the same parking spot may be designated at a second, different price during a second time period (e.g., 4:00 PM to 8:00 AM). For example, the first price may be higher than the second price to achieve a desired objective, such as affecting traffic, meeting revenue goals, etc. Any number of different time periods and prices may be used within the scope of the claimed invention. In embodiments, the parking manager is provided with or programmed to access data relating parking price to time of day, and may use this data to determine a parking rate for the vehicle initiating parking (e.g., initiating parking at step 410). The data relating the parking price to the time of day may be pre-defined or may be based on historical parking data that has been gathered and analyzed to identify times that experience high demand for parking.

In an additional example, the price of a particular parking spot may be adjusted based on the location of the parking spot and the current weather. For example, the price of covered parking spots (e.g., in a garage) may be designated at a first price during a first type of weather (e.g., rain, snow, sleet, etc.). The price of the same parking spot may be designated at a second, different price during a second type of weather (e.g., sunny, clear, etc.). For example, the first price may be higher than the second price to capitalize on a higher demand for covered parking spots during inclement weather. In embodiments, the parking manager is programmed to determine the current weather when the user initiates parking (e.g., initiates parking at step 410). For example, the parking manager may communicate with or otherwise access a weather website or other electronically available weather reporting service. The parking manager is also provided with or programmed to access data relating parking price (e.g., of one or more parking spots) to weather, and may use this data to determine a parking rate for the vehicle initiating parking (e.g., initiating parking at step 410).

In another example, the price of a particular parking spot may be adjusted based on the relative convenience of the parking spot. For example, parking spots that are relatively more convenient (e.g., in closer proximity to pedestrian ingress/egress points of the parking facility, elevators, landmarks, popular curb-side parking locations, etc.) may be priced differently (e.g., higher) than parking spots that are relatively less convenient (e.g., further away from the pedestrian ingress/egress points of the parking facility, elevators, landmarks, popular curb-side parking locations, etc.). In embodiments, the parking manager is provided with or programmed to access data that relates parking price to relative convenience of a parking spot, and may use this data to determine a parking rate for the vehicle initiating parking (e.g., initiating parking at step 410). The data relating the parking price to the relative convenience of a parking spot may be pre-defined or may be based on historical parking data that has been gathered and analyzed to identify preferred parking spots.

In an additional example, the price of a particular parking spot may be adjusted (e.g., discounted) based on promotions or subsidies. In embodiments, the user profile data may include information certifying that the registered vehicle is used for carpooling. The parking manager can access the user profile data associated with the vehicle initiating the parking (e.g., at step 410) based on the payment source data or vehicle identifier. In embodiments, the parking manager is also provided with or has access to data that defines a discounted rate for certified carpooling vehicles. In implementations, the parking manager is programmed to determine from this data whether the vehicle initiating the parking (e.g., at step 410) qualifies for a discounted parking price, and to apply this discount when determining a parking rate for the vehicle initiating parking (e.g., initiating parking at step 410).

In an additional example of the price of a particular parking spot being adjusted (e.g., discounted) based on promotions or subsidies, the user profile data may include information certifying that the registered vehicle is authorized to park in handicapped parking spots. The parking manager can access the user profile data associated with the vehicle initiating the parking (e.g., at step 410) based on the payment source data or vehicle identifier. In embodiments, the parking manager is also provided with or has access to data that defines a discounted rate for vehicles authorized to park in handicapped parking spots. In implementations, the parking manager is programmed to determine from this data whether the vehicle initiating the parking (e.g., at step 410) qualifies for a discounted parking price, and to apply this discount when determining a parking rate for the vehicle initiating parking (e.g., initiating parking at step 410).

Moreover, in addition to adjusting the price of a parking spot based on the registered vehicle is authorized to park in handicapped parking spots, the parking manager may also adjust the maximum time allowance for parking in a parking spot to provide extra available time for handicapped parkers. For example, the price of a parking spot may be determined at step 420 for a predefined maximum available parking time (e.g., two hours). When the parking manager determines form the user profile data that the vehicle is authorized to park in handicapped parking spots, the parking manager may adjust (e.g., increase) the maximum available parking time by a predefined amount (e.g., any suitable extra amount of time) to provide extra parking time to accommodate the handicapped parker.

Still referring to step 420 of FIG. 4, the parking manager may use none, one, or any combination of the above-noted factors in determining a parking price for the vehicle initiating parking (e.g., initiating parking at step 410). For example, the vehicle initiating the parking may qualify for a make and model discount as well as a carpooling discount, both of which would reduce the parking price. Additionally, the weather at the time of step 410 may be rainy, and the user intends to park in a premium parking spot that is both covered and close to an elevator, both of which may increase the parking price. The parking manager may apply all of these factors, and others, at step 420 in determining the parking price for the vehicle initiating parking (e.g., initiating parking at step 410). In embodiments, when no factors are used in determining an adjusted/variable price, the parking manager determines the price by looking up a pre-defined price for the parking spot in stored data (e.g., the database).

Furthermore, at step 420, the parking manager may determine respective prices for different parking spots that are currently available in the parking location associated with step 410. For example, a parking garage may have some uncovered parking spots and some covered parking spots, which may be priced differently during certain weather. Similarly, the more convenient parking spots in the same garage may be priced differently than other less convenient parking spots in the garage. In embodiments, the parking manager is programmed to determine the current parking rate for more than one parking spot in the location associated with step 410, so that the user initiating the parking may be provided with a choice of parking spots and respective parking rates.

In accordance with additional aspects of the invention, the parking manager may determine that the vehicle initiating the parking event is not authorized to park in a particular parking spot because the parking spot is reserved for handicapped parking and the user profile data does not indicated that this vehicle is authorized for handicapped parking. In embodiments, the central parking system may dynamically adjust (e.g., increase or decrease) the number and/or location of handicapped parking spots at a parking location (or plurality of locations), and save data defining the current number and location of handicapped parking spots. This data may be used in step 420 when determining a price of a parking spot. For example, when a user initiates the parking event (e.g., at step 410) and the parking manager determines from the user profile data that the user is not authorized to park in a handicapped parking spot, the parking manager may only determine prices for non-handicapped parking spots for this particular user. In this manner, and as described in greater detail below, the user will not be presented with the option of selecting a handicapped parking spot since the user is not qualified to park in such a parking spot.

At step 425, the parking manager transmits the one or more determined parking prices (e.g., from step 420) for one or more parking spots to the parking location computing device. At step 430, the parking location computing device presents the one or more determined parking prices and associated respective parking spot(s) to the user who is initiating the parking. For example, the parking location computing device may display the one or more determined parking prices, and respective parking spots associated with the prices, on a display device such as a screen. In embodiments, a user whose profile data does not indicate an authorization to park in handicapped parking spots is not presented with prices of handicapped parking spots at step 430 since the user is not qualified to park in such a parking spot. At step 435, the user selects a presented parking spot (e.g., from step 430). The selection may be performed in any suitable manner, such as using a touch screen or buttons on the parking location computing device. The user may also designate a duration of parking in the same manner as step 230.

At step 440, the parking location computing device transmits an indication of the user-selected parking spot (e.g., from step 430) to the parking manager. At step 445, the parking manager charges the user's payment source and updates the database to indicate that the vehicle is validly parked in a particular parking spot (and for a particular duration, if applicable). At step 450, the vehicle is parked at the appropriate parking spot.

In accordance with even further aspects of the invention, the parking manager may be configured to provide parking recommendations to registered user based on predefined preferences and/or historical data associated with the user. For example, a registered user may define preferences in their user profile data. The preferences may include, but are not limited to, a preference for covered or uncovered parking, a preference for more convenient parking spots that may have a higher price for parking, a preference for less expensive parking spots that may be less convenient, etc. The historical data may include data that the parking manager has gathered from previous parking events initiated by the user. This historical data may be analyzed to determine user parking habits or patterns, such as, for example, repeated parking at a particular location, parking at a particular time of day, parking at a particular type of parking spot (e.g., garage, lot, curbside, more/less convenient, higher/lower price), etc.

Figure 5:
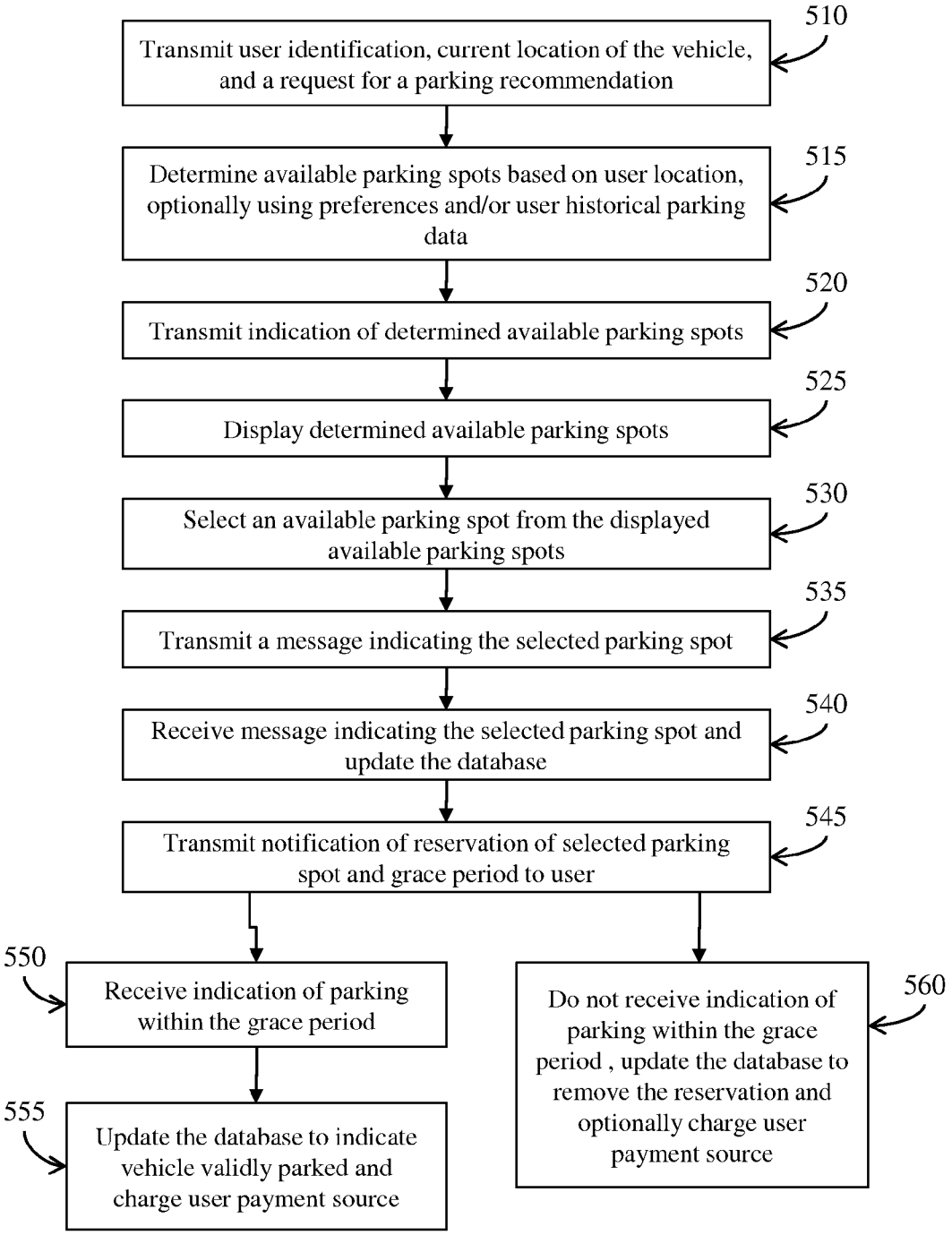

FIG. 5 shows an exemplary process flow in accordance with aspects of the invention for providing parking recommendations to a registered user. At step 510, a user computing device (e.g., user computing device 52) transmits the user identification, the current location of the vehicle, and a request for a parking recommendation to the parking manager (e.g., parking manager 46). The current location may be transmitted using any conventional or later-developed technique, such as mobile telephony communication (e.g., 2G, 3G, etc.), wireless broadband, etc. In implementations, the current user location is determined using a global positioning system (GPS) component of the user computing device. Alternatively, the user may manually enter their current location in the user computing device, e.g., by typing the current address into the user computing device. The user identification may be authentication information that is stored in the user profile data, such as a username (or account number) and password. The user identification may also be the vehicle identifier, such as the license plate number or VIN.

In a particular embodiment, the user computing device accesses a website or web-based application that facilitates communication between the user computing device and the parking manager. The user computing device presents a graphical user interface (GUI) to the user. The GUI may be associated with the website or web-based application and may be configured to guide the user through the parking recommendation and reservation process.

At step 515, the parking manager receives the data from step 510 and examines the database to determine available parking spots within a radius of the user's current location. The determined available parking spots may additionally be filtered (e.g., kept or discarded) and/or ranked (e.g., ordered in a list) according to predefined user preferences and/or historical data associated with the user. Available parking spots may be defined in the database as those parking spots that are not currently parked in or reserved.

At step 520, the parking manager transmits a list of determined available parking spaces to the user computing device. At step 525, the user computing device displays the determined available parking spaces, for example, in the GUI. The determined available parking spaces may be displayed in a list that is filtered and/or ordered based on predefined user preferences and/or historical data associated with the user. The determined available parking spaces may be displayed on an electronic map, along with the user's current location. Each of the determined available parking spaces may have an associated parking price that is also transmitted from the parking manager and displayed on the user computing device. The price may be pre-defined or may be a variable price that the parking manager determines as described in FIG. 4. In accordance with aspects of the invention, the GUI may be configured to provide additional data for each displayed parking spot, such as, for example, driving directions from the user location to the parking spot, restrictions associated with the parking spot, a description of the parking spot (e.g., garage, lot, curb-side, covered, uncovered, etc.).

At step 530, the user selects one of the displayed available parking spots to reserve the parking spot. In embodiments, the user provides an input component of the user computing device, such as a touch-screen or keypad, to make the selection at step 530. At step 535, the user computing device transmits a message indicating the selected parking spot (e.g., from step 530) to the parking manager.

At step 540, the parking manager receives the message indicating the selected parking spot (e.g., from step 535) and updates the database to mark the selected parking spot as reserved for a grace period. The grace period can be any desired amount of time that the selected parking spot is held for the user after the user selects the parking spot, in order to permit the user to drive to the parking spot from their current location. The grace period may be predefined, or may be based on a distance and/or estimated driving time between the user location and the selected parking spot.

At step 545, the parking manager transmits a notification to the user computing device that the selected parking spot has been reserved for the grace period. The notification may include an indication of the grace period, so that the user is aware of the time available to claim the parking spot.

At step 550, in a first possible outcome following step 545, the parking manager receives an indication that the user has parked in the selected parking spot within the grace period. In embodiments, the user indicates to the parking manager that they are parked in the selected spot by sending a confirmation message via the GUI, or alternatively by swiping or inserting their payment source (e.g., credit card, RFID tag, etc.) at a reader included in a parking location computing device where the selected parking spot is located (e.g., similar to step 220). At step 555, the parking manager updates the database to indicate that the vehicle is validly parked in the parking spot and charges the user's payment source for the selected parking event. A premium (e.g., additional fee) may optionally be added to the parking charge for using the recommendation and reservation system.

Alternatively to step 550, the parking manager may fail to receive an indication that the user has parked in the selected parking spot within the grace period. In such a circumstance, at step 560 the parking manager updates the database to remove the reservation of the parking spot (e.g., mark the parking spot as available for other users). The parking manager may optionally charge a nominal fee to the user's payment source for the lost opportunity cost of holding the parking reservation for the user.

As described herein, implementations of the invention provide a system and method to enable parking to be paid for at meters or park-and-pay machines, using a credit card, RFID, or a smart tag without the use of paper tickets. Parking enforcement may be achieved using the vehicle identifier, even though a paper receipt is not displayed in the windshield. Embodiments advantageously eliminate the need for patrons (e.g., drivers) to guess how long they are going to park, which helps avoid overpayment and underpayment while still holding patrons accountable if they park for longer than the maximum allowed time. Implementations may be used without a credit card. Moreover, the payment optimization system in accordance with aspects of the invention also enables variable price rates with respect to the make and model of the vehicle that is parked.

In this manner, implementations of the invention advantageously eliminate the need for acquiring and displaying a printed paper receipt for proof of parking. Implementations also provide flexible payment methods that do not require a user to estimate the length of time they will need a space in the parking structure. Embodiments provide for a variable pricing structure dependent on the make and model of the car, which may be used to promote energy savings. Variable pricing structures may also be used to promote desired driving and/or parking behavior by consumers.

In embodiments, a service provider, such as a Solution Integrator, could offer to perform the processes described herein. In this case, the service provider can create, maintain, deploy, support, etc., the computer infrastructure that performs the process steps of the invention for one or more customers. These customers may be, for example, any business that uses technology. In return, the service provider can receive payment from the customer(s) under a subscription and/or fee agreement and/or the service provider can receive payment from the sale of advertising content to one or more third parties.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

The corresponding structures, materials, acts, and equivalents of all means or step plus function elements in the claims, if applicable, are intended to include any structure, material, or act for performing the function in combination with other claimed elements as specifically claimed. The description of the present invention has been presented for purposes of illustration and description, but is not intended to be exhaustive or limited to the invention in the form disclosed. Many modifications and variations will be apparent to those of ordinary skill in the art without departing from the scope and spirit of the invention. The embodiment was chosen and described in order to best explain the principals of the invention and the practical application, and to enable others of ordinary skill in the art to understand the invention for various embodiments with various modifications as are suited to the particular use contemplated. Accordingly, while the invention has been described in terms of embodiments, those of skill in the art will recognize that the invention can be practiced with modifications and in the spirit and scope of the appended claims.

What is claimed is:

1. A parking management method implemented in a computer infrastructure having computer executable code tangibly embodied on a computer readable storage medium having programming instructions operable to:

associate a payment source with a vehicle identifier;

receive a message indicating initiation of a parking event at a parking location, wherein the message includes an identification of at least one of the payment source and the vehicle identifier;

update a parking database to indicate that a vehicle having the vehicle identifier is parked at the parking location;

further comprising:

determining, by a sensor at the parking location, the vehicle has left the parking location;

updating the parking database to reflect that the vehicle is no longer parked at the parking location;

determining when the vehicle left the parking location;

comparing an actual time parked at the parking location to a paid-for parking time, based on when the vehicle left the parking location; and performing one of: refunding the payment source when the paid-for parking time exceeds the actual parking time, and charging the payment source when the actual parking time exceeds the paid for parking time wherein the vehicle identifier comprises a license plate number or vehicle identification number (VIN) of the vehicle;

the payment source comprises one of: a credit card, a debit card, and a prepaid funds card; and the receiving the message comprises receiving the message from a parking location computing device, further comprising the parking location computing device obtaining information associated with one of the payment source and the vehicle identifier during the initiation of the parking event, wherein the obtaining the information comprises one of: reading a magnetic strip of a payment card; reading a radio frequency identification tag; and reading a bar code.

* * * * *